US007859426B2

(12) United States Patent
Clark et al.

(10) Patent No.: US 7,859,426 B2
(45) Date of Patent: Dec. 28, 2010

(54) ELECTROMAGNETIC WELLBORE TELEMETRY SYSTEM FOR TUBULAR STRINGS

(75) Inventors: Brian Clark, Sugar Land, TX (US); Nobuyoshi Niina, Cheltenham (GB)

(73) Assignee: Intelliserv, LLC, Houston, TX (US)

( * ) Notice: Subject to any disclaimer, the term of this patent is extended or adjusted under 35 U.S.C. 154(b) by 0 days.

(21) Appl. No.: 12/555,540

(22) Filed: Sep. 8, 2009

(65) Prior Publication Data

US 2009/0322553 A1 Dec. 31, 2009

Related U.S. Application Data

(62) Division of application No. 11/456,464, filed on Jul. 10, 2006, now Pat. No. 7,605,715.

(51) Int. Cl.
*G01V 3/00* (2006.01)

(52) U.S. Cl. ..... 340/854.4; 340/854.6; 439/191; 174/47; 367/82

(58) Field of Classification Search ... 340/854.4–854.6; 439/191; 175/104; 174/47; 367/82, 84
See application file for complete search history.

(56) References Cited

U.S. PATENT DOCUMENTS

| | | | | |
|---|---|---|---|---|
| 2,000,716 | A | 5/1935 | Polk | |
| 2,096,359 | A | 10/1937 | Hawthorn | |
| 2,178,931 | A | 11/1939 | Crites | |
| 2,531,120 | A | 11/1950 | Feaster | |
| 3,170,137 | A | 2/1965 | Brandt | |
| 3,518,608 | A | 6/1970 | Papadopoulos | |
| 3,518,609 | A | 6/1970 | Fontenot, Jr. | |
| 3,696,332 | A | 10/1972 | Dickson, Jr. et al. | |
| 4,012,092 | A | 3/1977 | Godbey | |
| 4,095,865 | A | 6/1978 | Denison et al. | |
| 4,176,894 | A | 12/1979 | Godbey | |
| 4,220,381 | A | 9/1980 | van der Graaf | |
| 4,537,457 | A | 8/1985 | Davis, Jr. et al. | |
| 4,591,226 | A | 5/1986 | Hargett et al. | |
| 4,722,402 | A | 2/1988 | Weldon | |
| 4,914,433 | A | 4/1990 | Galle | |
| 4,953,636 | A | 9/1990 | Mohn | |
| 5,517,464 | A | 5/1996 | Lerner et al. | |
| 5,642,051 | A | 6/1997 | Babour et al. | |
| 6,641,434 | B2 | 11/2003 | Boyle et al. | |
| 7,605,715 | B2 * | 10/2009 | Clark et al. | 340/854.4 |
| 2004/0156264 | A1 | 8/2004 | Gardner et al. | |
| 2004/0242044 | A1 | 12/2004 | Head | |
| 2005/0024232 | A1 | 2/2005 | Gardner et al. | |
| 2005/0285753 | A1 | 12/2005 | Shah et al. | |
| 2006/0098531 | A1 | 5/2006 | Gardner et al. | |
| 2006/0114746 | A1 | 6/2006 | Gardner et al. | |

* cited by examiner

*Primary Examiner*—Albert K Wong
(74) *Attorney, Agent, or Firm*—Conley Rose, P.C.

(57) ABSTRACT

A coaxial transmission line for an electromagnetic wellbore telemetry system is disclosed. An inner conductive pipe is disposed inside an axial bore of the outer conductive pipe. An insulator is positioned between the outer conductive pipe and the inner conductive pipe. In a specific embodiment, the inner conductive pipe is perforated or slotted.

11 Claims, 10 Drawing Sheets

ELECTROMAGNETIC WELLBORE TELEMETRY SYSTEM FOR TUBULAR STRINGS

PRIORITY CLAIMS AND RELATED APPLICATIONS

The present application is a divisional patent application and claims priority from U.S. patent application Ser. No. 11/456,464, entitled "Electromagnetic Wellbore Telemetry System for Tubular Strings," filed on Jul. 10, 2006 now U.S. Pat. No.7,605,715, which is hereby incorporated by reference in its entirety.

BACKGROUND OF THE INVENTION

The invention relates to wellbore telemetry systems for transmitting signals to and receiving signals from downhole tools, such as used in oilfield operations. Wellbores are drilled through underground formations to locate and produce hydrocarbons and/or water. A wellbore is formed by advancing a downhole drilling tool with a bit at an end thereof into an underground formation. Drilling is usually accompanied by circulation of drilling mud from a mud pit at the surface, down the drilling tool and bit, up the wellbore annulus formed between the wellbore wall and downhole drilling tool, and back into the mud pit. During drilling, wellbore telemetry devices may be used to provide communication between the surface and the downhole tool. The wellbore telemetry devices may allow power, command and/or other communication signals to pass between a surface unit and the downhole tool. These signals may be used to control and/or power operation of the downhole tool and/or send downhole information to the surface.

Many drilling operations use mud pulse wellbore telemetry, such as described in U.S. Pat. No. 5,517,464, to transmit signals between a downhole tool and a surface unit. Data transmission rates with mud pulse telemetry are typically in the range of 1-6 bits/second. Wired drill pipe telemetry systems, such as described in U.S. Pat. No. 6,641,434, can enable much higher transmission rates from locations near the drill bit to a surface location. Other examples of wellbore telemetry systems include, but are not limited to, electromagnetic wellbore telemetry systems, such as described in U.S. Pat. No. 5,624,051, and acoustic wellbore telemetry systems, such as described in PCT International Publication No. WO 2004/085796.

Despite the development and advancement of wellbore telemetry systems, there continues to be a need for a reliable high-speed, broadband telemetry system for transmission of signals between locations in a wellbore and locations on the surface.

SUMMARY OF THE INVENTION

In one aspect, the invention relates to a coaxial transmission line for an electromagnetic wellbore telemetry system which comprises an outer conductive pipe, an inner conductive pipe disposed coaxially inside an axial bore of the outer conductive pipe, a first electrical contact having a first contact face disposed at a first end of the inner conductive pipe, a second electrical contact having a second contact face disposed at a second end of the inner conductive pipe, wherein at least one of the first and second contact faces includes at least one slot, and an insulator disposed between the outer conductive pipe and the inner conductive pipe.

In another aspect, the invention relates to a coaxial transmission line for an electromagnetic wellbore telemetry system which comprises an outer conductive pipe, a perforated or slotted inner conductive pipe disposed coaxially inside an axial bore of the outer conductive pipe, a first electrical contact having a first contact face disposed at a first end of the inner conductive pipe, a second electrical contact having a second contact face disposed at a second end of the inner conductive pipe, and an insulator disposed between the inner conductive pipe and the outer conductive pipe.

In another aspect, the invention relates to an electromagnetic wellbore telemetry system which comprises a plurality of the coaxial transmission lines as described above coupled together in the form of a tubular string for an oilfield operation.

In another aspect, the invention relates to a method of making a coaxial transmission line as described above which comprises attaching first and second electrical contacts to distal ends of an inner conductive pipe, applying an insulator on the outer surface of the inner conductive pipe, inserting the inner conductive pipe and insulator into an outer conductive pipe, and expanding the inner conductive pipe to conform the inner conductive pipe to the inner geometry of the outer conductive pipe.

In yet another aspect, the invention relates to a method of making a coaxial transmission line for an electromagnetic wellbore telemetry system which comprises attaching first and second electrical contacts to distal ends of an inner conductive pipe, arranging an outer conductive pipe coaxially with the inner conductive pipe, and disposing an insulator between the inner conductive pipe and the outer conductive pipe.

In another aspect, the invention relates to a method of providing communication between a downhole tool in a wellbore penetrating an underground formation and a surface unit which comprises connecting a plurality of coaxial transmission lines as described above together, coupling the plurality of coaxial transmission lines to the downhole tool, and establishing communication between the coaxial transmission lines and the surface unit.

Other features and advantages of the invention will be apparent from the following description and the appended claims.

BRIEF DESCRIPTION OF THE DRAWINGS

The accompanying drawings, described below, illustrate typical embodiments of the invention and are not to be considered limiting of the scope of the invention, for the invention may admit to other equally effective embodiments. The figures are not necessarily to scale, and certain features and certain view of the figures may be shown exaggerated in scale or in schematic in the interest of clarity and conciseness.

DETAILED DESCRIPTION

Figure 1:
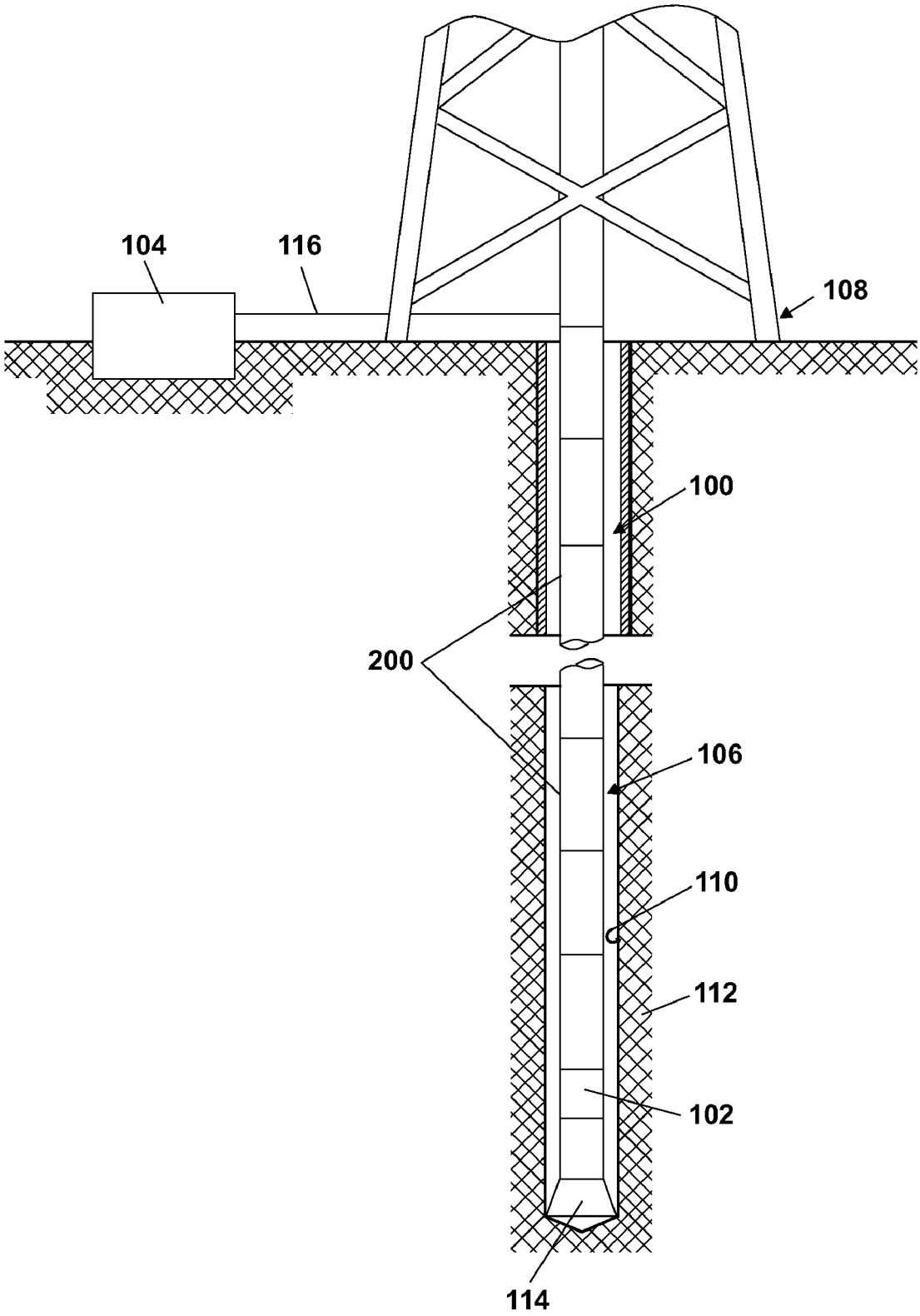
FIG. 1 is a schematic of an electromagnetic wellbore telemetry system.

The invention will now be described in detail with reference to a few preferred embodiments, as illustrated in the accompanying drawings. In describing the preferred embodiments, numerous specific details are set forth in order to provide a thorough understanding of the invention. However, it will be apparent to one skilled in the art that the invention may be practiced without some or all of these specific details. In other instances, well-known features and/or process steps have not been described in detail so as not to unnecessarily obscure the invention. In addition, like or identical reference numerals are used to identify common or similar elements.

FIG. 1 depicts an electromagnetic wellbore telemetry system 100 for two-way communication between one or more downhole tools, such as depicted at 102, and one or more surface units, such as depicted at 104. That is, using the electromagnetic wellbore telemetry system 100, signals can be transmitted from the downhole tool 102 to the surface unit 104 or from the surface unit 104 to the downhole tool 102. Such signals may be instructions to operate the downhole tool 102 or data from the downhole tool 102. The signals may also be electrical power to operate the downhole tool 102. The surface unit 104 is shown onsite but may be located offsite and/or communicate with another surface unit located offsite. A communication line 116 between the electromagnetic wellbore telemetry system 100 and the surface unit 104 may be established using any suitable method. The electromagnetic wellbore telemetry system 100 can be in the form of any tubular string for oilfield operations. Examples of tubular strings for oilfield operations include, but are not limited to, drill strings, completion tubing strings, production tubing strings, casing strings, and risers.

For illustration purposes, the electromagnetic wellbore telemetry system 100 is in the form of a drill string 106 having a plurality of pipe joints 200, each of which provides a coaxial transmission line. Self-cleaning electrical contacts (not visible in the drawing) integrated at the ends of the pipe joints 200 connect the coaxial transmission lines with low contact resistance to enable quality signal transmission along the drill string 106. The coaxial transmission lines can also be used to transmit electrical power to a downhole tool in the drill string 106. In general, any downhole tool that can be included in the drill string 106 may communicate with the surface unit 104 through the coaxial transmission line provided by the pipe joints 200. Examples of these tools include, but are not limited to, heavy-weight drill pipes, jars, under-reamers, measurement-while-drilling (MWD), logging-while-drilling (LWD) tools, directional drilling tools, and drill bits. The drill string 106 extends from the drilling rig 108 into a wellbore 110 in an underground formation 112. The drill string 106 carries downhole tools, such as a drill bit 114 for drilling the wellbore 110 and a MWD tool 102 for measuring conditions downhole. The pipe joints 200 double up as a conduit for carrying drilling mud from the surface to the drill bit 114.

Figure 2:
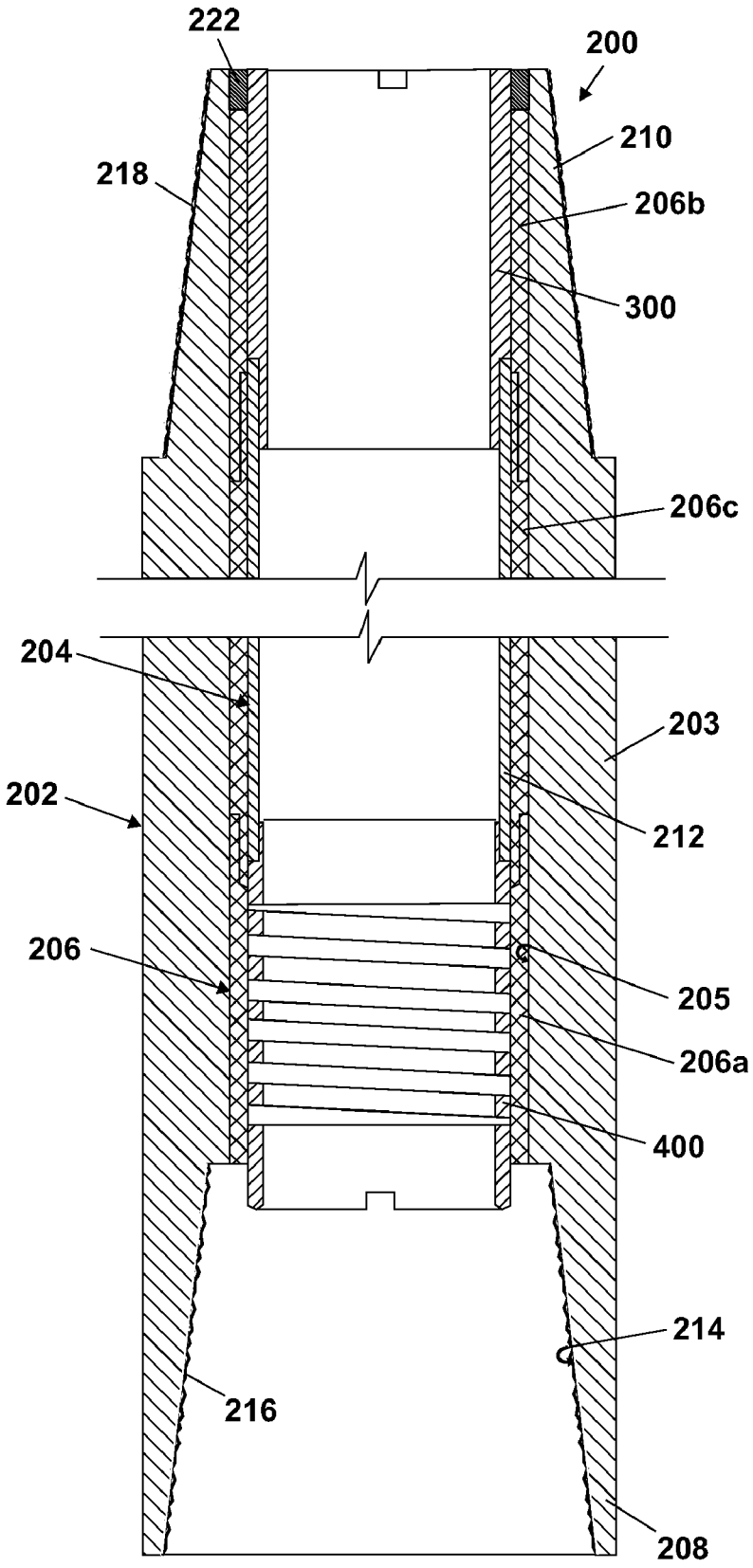
FIG. 2 is a cross-section of a coaxial transmission line for an electromagnetic wellbore telemetry system.

FIG. 2 depicts a cross-section of a coaxial transmission line or pipe joint 200 of the electromagnetic wellbore telemetry system (100 in FIG. 1). The structure of the pipe joint 200 would generally remain the same regardless of the form of tubular string the electromagnetic wellbore telemetry system takes. The coaxial transmission line 200 includes an outer tubular conductor 202, an inner tubular conductor 204 disposed inside and arranged coaxially with the outer tubular conductor 202, and an insulator 206 disposed between the outer tubular conductor 202 and the inner tubular conductor 204. The thickness of the conductors 202, 204 and insulator 206 may or may not be uniform along the length of the pipe joint 200. The insulating properties of the insulator 206 may or may not be uniform along the length of the pipe joint 200. The inner tubular conductor 204 may allow passage of drilling mud and downhole tools. In this coaxial arrangement, electrical currents flow on the outer tubular conductor 202 and the inner tubular conductor 204, while electromagnetic fields that carry signals exist primarily in the insulator 206.

The outer tubular conductor 202 includes an outer conductive pipe 203 having an axial bore 205 and first and second connectors 208, 210 disposed at distal ends thereof. The outer conductive pipe 203 may be any suitable conductive tubular known in oilfield operations. For example, the outer conductive pipe 203 may be a drill pipe, casing, tubing, or riser. The outer conductive pipe 203 is preferably made of a conductive material or materials that maintain their physical and chemical integrity in borehole conditions. The first connector 208 may be a box connector and the second connector 210 may be a pin connector in a manner well known in the art for oilfield tubulars such as drill pipes. The box connector 208 may include an enlarged bore 214 and thread(s) 216. The pin connector 208 may be shaped for insertion in the bore of a box connector and may include thread(s) 218 for engagement with the box connector.

The inner tubular conductor 204 includes an inner conductive pipe 212 and electrical contacts 300, 400 attached to the ends of the conducting tube 212 such that there is electrical continuity between the inner conductive pipe 212 and the electrical contacts 300, 400. The inner conductive pipe 212 is fitted inside the axial bore 205 of the outer conductive pipe 203, with the electrical contacts 400, 300 adjacent the first and second connectors 208, 210 at the ends of the outer conductive pipe 203. When a series of pipe joints 200 are connected together, the electrical contacts 300, 400 mate with similar electrical contacts in adjacent pipe joints 200 to provide electrical connections between the adjacent pipe joints 200. The inner conductive pipe 212 is preferably made of a conductive material or materials that maintain their physical and chemical integrity in borehole conditions. The inner conductive pipe 212 may be entirely conductive or may have a combination of conductive and non-conductive portions, provided that positioning of the non-conductive portions allow conductive paths along the length of the tube. The inner conductive pipe 212 may be solid or may be slotted or perforated, provided the holes or slots in the inner conductive pipe 212 allow conductive path(s) along the length of the pipe.

The electrical contacts 300, 400 can be fixed or moving contacts. Herein, a fixed contact has a contact face that cannot move along the axial axis of the pipe joint 200 whereas a moving contact has a contact face that can move along the axial axis of the pipe joint 200. The electrical contacts 300, 400 may both be fixed contacts or moving contacts. Preferably, one of the electrical contacts 300, 400 is a fixed contact while the other is a moving contact. For example, in FIG. 2, the electrical contact 400 is depicted as a moving contact while the electrical contact 300 is depicted as a fixed contact. The orientation of the inner tubular conductor 204 within the outer tubular conductor 202 may be such that the moving contact 400 is at the box connector 208 and the fixed contact 300 is at the pin connector 210, or vice versa. The end face of the electrical contact 300 adjacent to the pin connector 210 may be flush with the end face of the pin connector 210, while the end face of the electrical contact 400 adjacent to the box connector 208 may be recessed relative to the end face of the box connector 208. In general, the position of the electrical contacts 300, 400 relative to the connectors 210, 208 may be adjusted as necessary to assure electrical connection with other electrical contacts in adjacent pipe joints (not shown).

The insulator 206 disposed between the outer tubular conductor 202 and the inner tubular conductor 204 may be of single-piece construction, extending along the length of the outer conductive pipe 203, or may be of multi-piece construction. A multi-piece insulator 206 may include an insulator sleeve (or coating) 206*a* for the electrical contact 400, an insulator sleeve (or coating) 206*b* for the electrical contact 300, and an insulator sleeve (or coating) 206*c* for the inner conductive pipe 212. Each insulator piece may be tailored in property and thickness to the corresponding adjacent conductor. The insulator 206 may also have a single layer or multiple layers. Suitable insulating materials are those that can withstand borehole conditions. Examples include, but are not limited to, epoxy, epoxy-fiberglass, epoxy-phenolic, plastics, rubber, and thermoplastics. The thickness of the insulator 206 is such that electrical isolation of the tubular conductors 202, 204 is maintained in use. When two pipe joints 200 are connected together, there may be a gap between the opposing ends of the insulator 206 in the pipe joints. An annular seal 222 may be disposed at an end of the insulator 206 to fill such a gap, thereby reducing losses. The annular seal 222 may be made of an insulating material, which may or may not be the same as that used in the insulator 206. The annular seal 222 may be an O-ring seal, as shown, or may be selected from other types of circumferential seals.

Figure 3A:
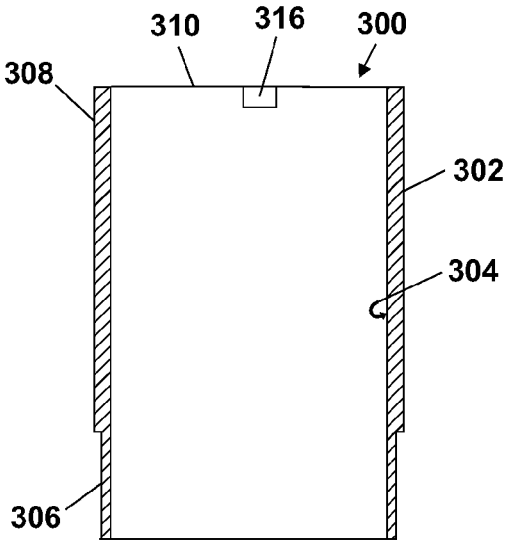
FIG. 3A is a cross-section of a fixed contact for use in the coaxial transmission line of FIG. 2.
Figure 3B:
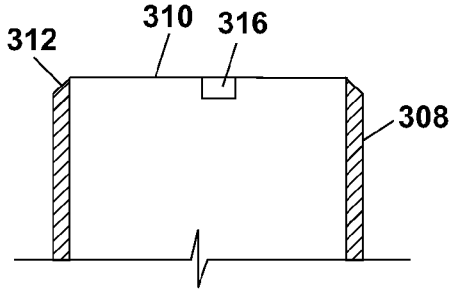
FIGS. 3B-3D show tapers on the contact face of the fixed contact of FIG. 3A.
Figure 3C:
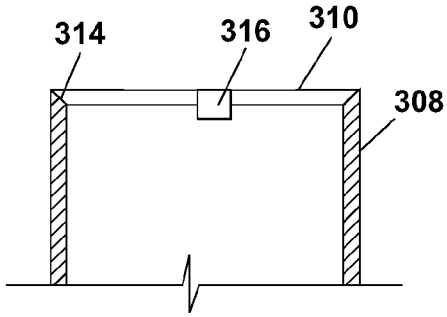
Figure 3D:
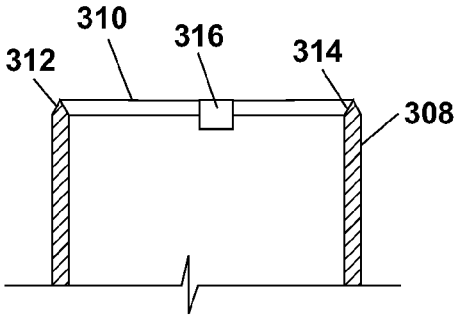
Figure 3E:
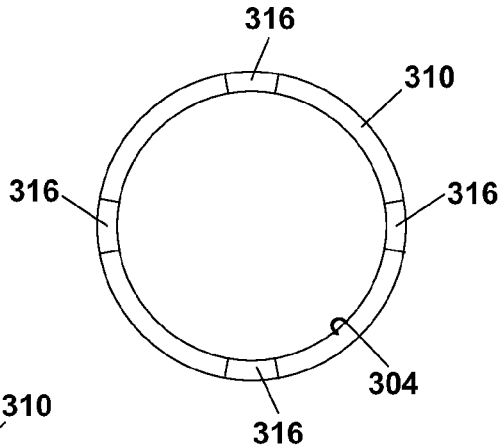
FIGS. 3E-3F are end views of the fixed contact of FIG. 3A and show wiping slots on the contact face of the fixed contact.
Figure 3F:
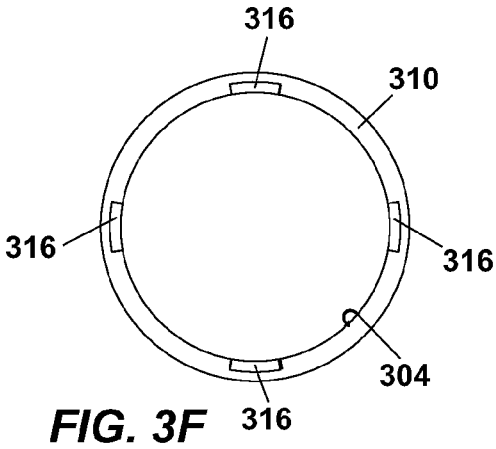

FIG. 3A depicts the electrical contact 300 as having a tubular body 302 with an axial bore 304. The tubular body 302 is made of a conductive material, preferably one that maintains its chemical and physical integrity in the presence of borehole fluids. One example of such a material is stainless steel. The tubular body 302 may or may not be made entirely of the conductive material as long as there are conductive paths in the tubular body 302 for electrical continuity with the inner conductive pipe (212 in FIG. 2). The tubular body 302 has distal ends 306, 308. The distal end 306 may be attached to the inner conductive pipe (212 in FIG. 2) using any suitable method, provided that the method ensures electrical continuity between the inner conductive pipe and the tubular body 302. For example, the distal end 306 could be brazed, soldered, welded, threaded, or compression fit to the inner conductive pipe. The distal end 308 includes an annular contact face 310. In this example, the annular contact face 310 does not move axially. The contact face 310 may be flat, as shown in FIG. 3A, or may include an outer taper 312, as shown in FIG. 3B, or an inner taper 314, as shown in FIG. 3C, or an outer taper 312 and an inner taper 314 (or bevel), as shown in FIG. 3D. In FIGS. 3A-3D, the contact face 310 includes one or more wiping slots 316. As more clearly shown in FIG. 3E, the wiping slots 316 may be open, that is, extending through the wall thickness of the tubular body 302, or as shown in FIG. 3F, the wiping slots 316 may be blind, that is, extending partially into the thickness of the tubular body 302 and open to the bore 304. Where multiple wiping slots 316 are provided, the wiping slots 316 may be arranged at even or uneven intervals along the contact face 310.

Figure 4A:
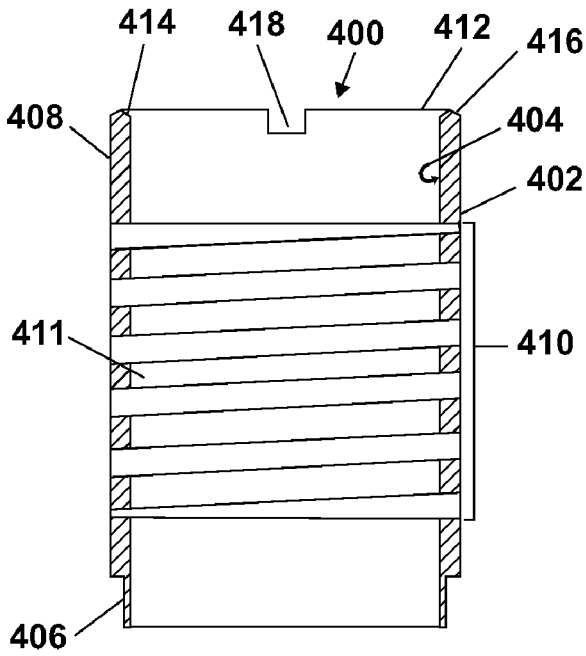
FIG. 4A is a cross-section of a moving contact for use in the coaxial transmission line of FIG. 2.

FIG. 4A depicts the electrical contact 400 as having a tubular body 402 with an axial bore 404. The tubular body 402 is made of a conductive material, preferably one that maintains its chemical and physical integrity in the presence of borehole fluids. One example of such a material is stainless steel. The tubular body 402 may or may not be made entirely of the conductive material as long as there are conductive paths in the tubular body 402 for electrical continuity with the conductive tube (212 in FIG. 2). The tubular body 402 has distal ends 406, 408. The distal end 406 may be attached to the conducting tube (212 in FIG. 2) using any suitable method, provided that the method ensures electrical continuity between the conducting tube and the tubular body 402. The distal end 408 includes a contact face 412. In FIG. 4A, the contact face 412 includes inner and outer tapers 414, 416. In alternate embodiments, the contact face 412 may include only an inner taper 414 or only an outer taper 416 or may be flat, as previously described for contact face (310 in FIGS. 3A-3F) of the fixed contact. The contact face 412 includes one or more wiping slots 418. The wiping slots 418 may be open or blind and may be arranged at even or uneven intervals along the contact face 412, as previously described for the wiping slots (316 in FIGS. 3E and 3F) of the fixed contact. The number and sizes of the wiping slots in the contact face of the fixed contact and the contact face of the moving contact do not need to be the same. Moreover, wiping slots may be omitted from one of the fixed contact and moving contact.

Figure 4B:
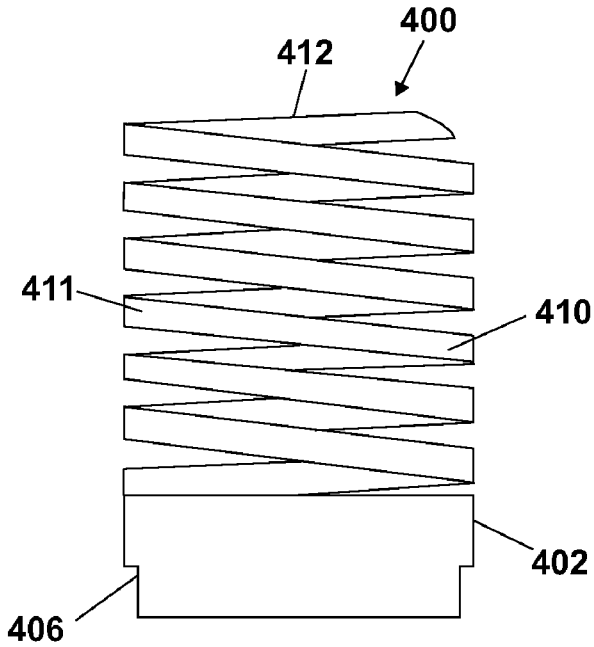
FIG. 4B is a variation of the moving contact of FIG. 4A with a terminal end of a spring used as a contact face.

Returning to FIG. 4A, a spring member 410 is disposed between the distal ends 406, 408 of the tubular body 402. The spring member 410 allows the contact face 412 to be movable axially, making the electrical contact 400 a moving contact. When the contact face 412 is in a mating position, the spring member 410 biases the contact face 412 against a mating contact face on an adjacent pipe joint, thereby maintaining a positive contact between the mating contact faces. FIG. 4B shows that a terminal or distal end of the spring member 410 may also provide the moving contact face 412. Referring to FIGS. 4A and 4B, the spring member 410 may be a helical or coil spring. The spring member 410 may be a single-start spring or a multi-start spring. In one example, a single-start spring includes a continuous coil or helix 411 as shown in FIGS. 4A and 4B. Spaces may or may not be provided between the coils of the spring member 410. A multi-start spring may have multiple intertwined continuous coils. This is akin to putting multiple independent helixes in the same cylindrical plane. A multi-start spring can cancel moments such that the spring force action is at the coil mean centerline.

Referring to FIGS. 4A and 4B, the tubular body 402 of the electrical contact 400 may be of a single-piece construction or of a multi-piece construction. In one example, a single-piece tubular body 402 is made by machining or otherwise forming a spring member 410 in a middle or distal (end) portion of a generally cylindrical body having an axial bore. The axial bore may be formed in the generally cylindrical body before or after forming the spring member. In a multi-piece construction, the tubular body 402 includes a first tubular section, which is attachable to the inner conductive pipe (212 in FIG. 2), a spring section or member, which is attachable to the first tubular section, and optionally a second tubular section which is attachable to the spring section or member.

Where the second tubular section is not included, the spring section or member may provide the contact face. Where the second tubular section is included, the second tubular section provides the contact face.

The contact face (310 in FIGS. 3A-3D) of the electrical contact (300 in FIGS. 3A-3D) and the contact face (412 in FIGS. 4A-4C) of the electrical contact (400 in FIGS. 4A-4C) are preferably made of a low resistivity material so that when they mate with adjacent contact faces the electrical path between the mating contact faces has a low resistance. It may be convenient to make the entire body of the electrical contacts from a low resistivity material. Preferably, the low resistivity material is chemically inert to borehole fluids. Examples of suitable materials (metals or alloys) include, but are not limited to, beryllium-copper having a resistivity of $7\times10^{-8}$ Ω-m and aluminum bronze having a resistivity of $1.2\times10^{-7}$ Ω-m. Stainless steel, for example, having a resistivity of $7.2\times10^{-7}$ Ω-m, may also be used. In general, the lower the metal resistivity, the lower the contact resistance.

Figure 5A:
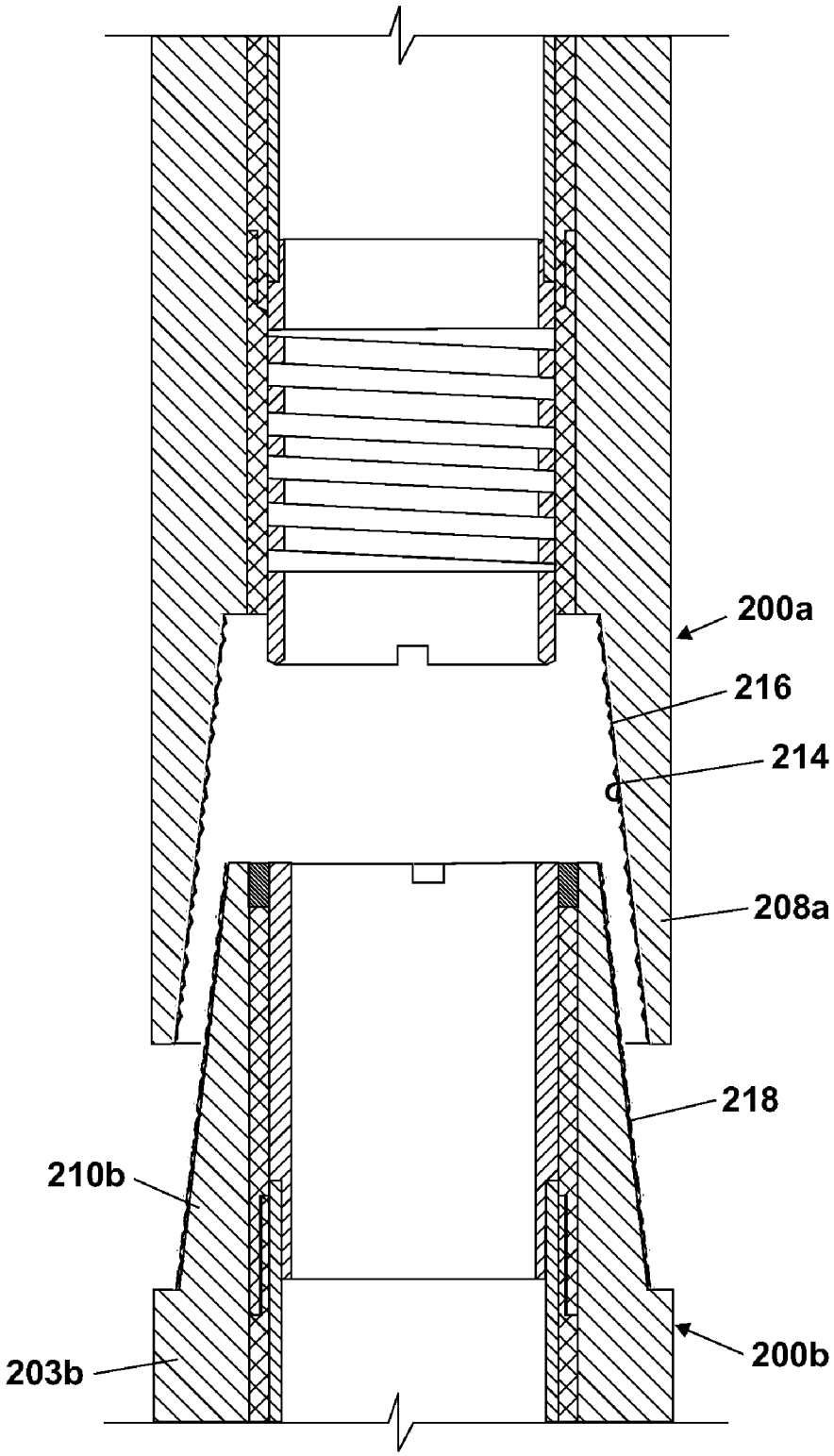
FIGS. 5A and 5B show two coaxial transmission lines for an electromagnetic wellbore telemetry system before and after the coaxial transmission lines are coupled together.

FIG. 5A shows ends of two pipe joints 200*a*, 200*b* before the pipe joints are made-up or connected together. The pipe joints 200*a*, 200*b* are the same as the pipe joint (200 in FIG. 2). The enlarged bore 214 of the box connector 208*a* of the pipe joint 200*a* is aligned to receive the pin connector 210*b* of the outer conductive pipe 203*b* of the pipe joint 200*b*. The wall of the enlarged bore 214 of the box connector 208*a* includes one or more threads 216. The pin connector 210*b* also includes one or more threads 218 for engagement with the thread(s) 216 on the wall of the enlarged bore 214.

Figure 5B:
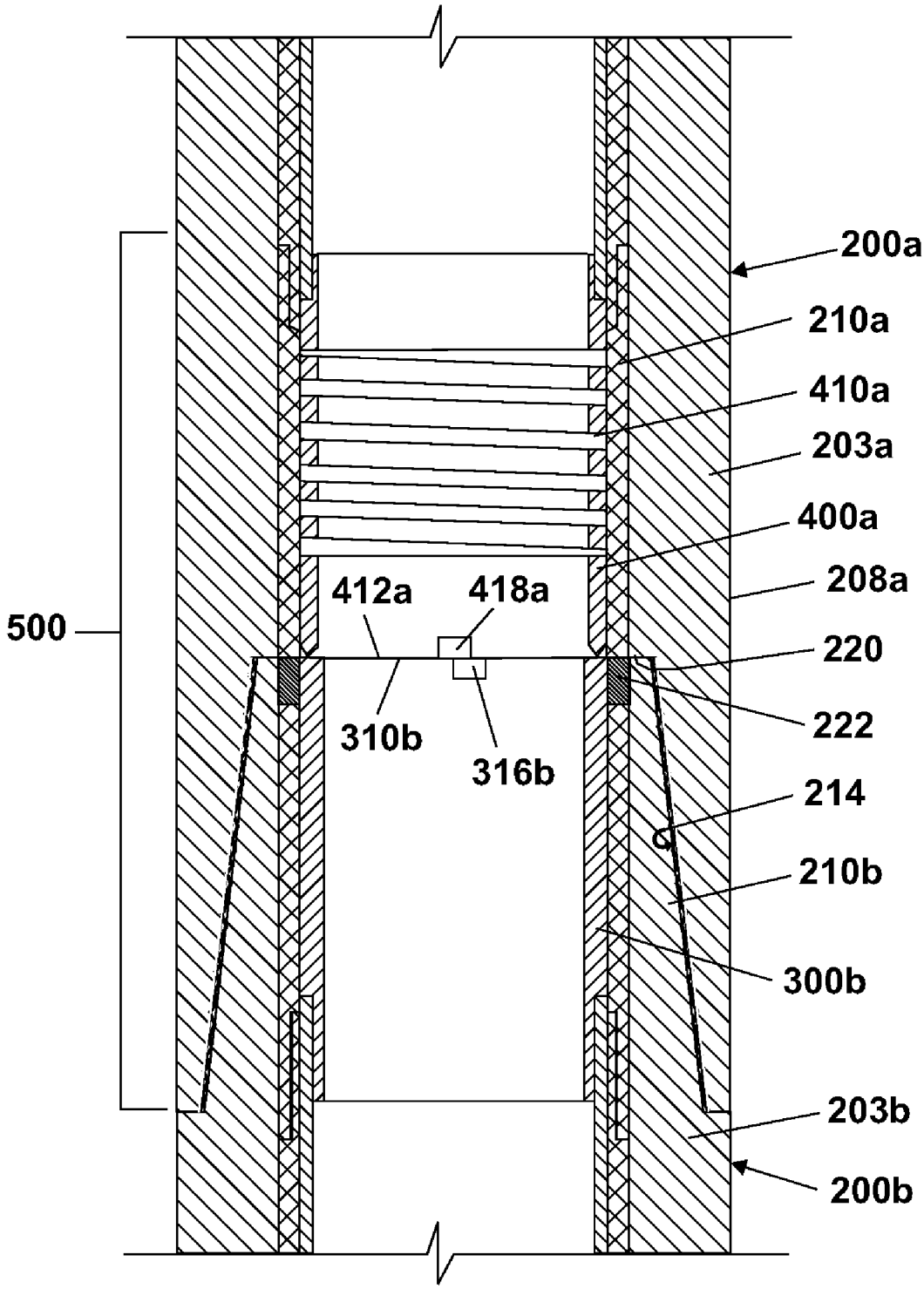

FIG. 5B shows pipe joints 200*a*, 200*b* connected together. The pin connector 210*b* of the outer conductive pipe 203*b* has been received in the enlarged bore 214 of the box connector 208*a* of the outer conductive pipe 203*a* and has engaged the box connector 208*a*. The electrical contact 400*a* is in contact with the electrical contact 300*b* and has been compressed to its final mating position at the base 220 of the enlarged bore 214. In the mating position, the spring member 410*a* exerts a biasing force on the electrical contact 300*b* and maintains the contact faces 310*b*, 412*a* in contacting relation. The contact between the pin connector 210*b* and the box connector 208*a* and the contact between the electrical contacts 300*b*, 400*a* thus constitute the electrical connection 500 between the pipe joints 200*a*, 200*b*. It should be noted that the invention is not limited to coupling the pin connector 210*b* and the box connector 208*a* via threads. Any method for coupling pipes that would allow electrical continuity between the pipes and that is usable in an oilfield environment may be used. In addition, the annular seal 222 bridges any gap between the insulators 206*a*, 206*b* of the pipe joints 200*a*, 200*b*, thereby reducing losses. Typically, it is not necessary for the annular seal 222 to maintain a pressure seal at the connection between the pipe joints 200*a*, 200*b*.

To connect the pipe joints 200*a*, 200*b* together as shown in FIG. 5B, the pipe joint 200*b* is aligned with the pipe joint 200*a* (as shown in FIG. 5A) and rotated relative to the 200*a*, or vice versa, to allow the pin connector 210*b* to engage the box connector 208*a*. The pin connector 210*b* and box connector 208*a* may be designed such that the pipe joints 200*a*, 200*b* self-align automatically when the pin connector 210*b* is stabbed into the box connector 208*a*. In one example, once the threads 218 on the pin connector 210*b* and threads 216 on the box connector 208*a* engage, the pin connector 210*b* and box connector 208*a* are aligned on the axis of the pipe joints 200*a*, 200*b* with at least one complete rotation remaining to complete the make-up between the pipe joints 200*a*, 200*b*. Consequently, the moving contact 400*a* is rotated relative to the opposing fixed contact 300*b* for at least one 360-degree rotation if the moving contact 400*a* travels at least one thread thickness.

When pipe joints are made up, drilling mud and debris that can interfere with making good electrical contact between the pipe joints may be present. For example, where the pipe joints have already been in the wellbore and are pulled out of the wellbore, drilling mud or cement on the inside of the pipe joints may dry out. The drilling mud may contain formation cuttings such as sand particles and lost circulation materials such as nut plug. These dried-out materials or debris are typically insulating and can fall on and form an insulating layer between the electrical contacts during make-up of the pipe joints, resulting in a high resistance between the pipe joints. Therefore, it is essential to remove such insulating debris from the contacts. In FIG. 5B, when the contact face 412*a* of the moving contact 400*a* touches the contact face 310*b* of the fixed contact 300*b*, the biasing force of the spring member 410*a* and the relative rotation between the contact faces 412*a*, 310*b* clears debris away from between the contact faces 412*a*, 310*b*. Further, the slots 418*a*, 316*b* in the contact faces allow the debris to fall into the bore of the contacts 400*a*, 300*b* instead of being trapped between the contact faces 412*a*, 310*b*. The slots when they appear on both contact faces 412*a*, 310*b* can also shear debris in a scissors-like action, making it easier for the debris to be cleared away.

A test was conducted to investigate the effectiveness of slots in wiping debris from between contact faces. In one configuration, the fixed and moving contacts had flat contact faces and slots in the contact faces. In another configuration, the fixed and moving contacts had tapered contact faces without slots in the contact faces. For both configurations, the fixed contact was placed in a fixture. Then, oil-based mud and nut plug/sand mixture (debris) were poured into the fixture. The nut plug/sand mixture had 10% sand and a nut plug concentration of 100 lbs/bbl. Then the moving contact was placed in the fixture in opposing relation to the fixed contact and brought into contact with the fixed contact. The spring load of the moving contact ranged from 3.2 lbs to 10.3 lbs (14 N to 46 N) on the fixed contact. For each spring load, the fixed contact was turned 360° relative to the moving contact, and the contact resistance between the fixed and moving contact faces was measured. The contact resistance was also measured for each spring force prior to turning the fixed contact.

Table 1 shows the result of the test described above. The flat contacts with the slots effectively cleared the nut plug/sand at a spring load of 3.2 lbs, with the contact resistance dropping from 8.5 MΩ ($8.5\times10^{6}$Ω) before wiping to 0.1 mΩ ($10^{-4}$Ω) after wiping. The tapered contacts without the slots did not produce the same low contact resistance until the spring load reached about 8.9 lbs.

TABLE 1

| | Flat contacts | | Tapered contacts | |
|---|---|---|---|---|
| Spring force | Before wiping | After wiping | Before wiping | After wiping |
| 3.2 lbs (14 N) | 8.5 MΩ | 0.1 mΩ | 117 Ω | 10 MΩ |
| 4.6 lbs (21 N) | | | 12 MΩ | 7 MΩ |
| 6.1 lbs (27 N) | | | 7 MΩ | 8.1 mΩ |
| 7.4 lbs (33 N) | | | 6.1 mΩ | 0.9 mΩ |
| 8.9 lbs (40 N) | | | 1.0 mΩ | 0.1 mΩ |
| 10.3 lbs (46 N) | | | 0.1 mΩ | 0.1 mΩ |

To confirm the effectiveness of the wiping slots, the tapered contacts were then modified to include slots at 120° intervals. The test described above was repeated for the modified tapered contacts. Table 2 shows the contact resistance between the contact faces before and after wiping. As can be observed from Table 2, a spring load of 3.2 lbs was sufficient to achieve a contact resistance of 0.1 mΩ after wiping.

TABLE 2

| | Tapered contacts with slots in upper & lower contacts | |
|---|---|---|
| Spring force | Before wiping | After wiping |
| 3.2 lbs (14 N) | 8.4 MΩ | 0.1 mΩ |

During drilling, drill pipes can be exposed to high shock levels, especially in the transverse direction. Such shocks are caused when a drill pipe strikes a casing in the wellbore, producing a very sudden acceleration. Axial shocks can occur lower in the drill string under stick-slip conditions. When one of the electrical contacts at the connection between pipe joints is moving, any shocks that are sufficiently great to overcome the spring force of the moving contact can result temporarily in an open circuit. If debris lodges between the contacts and prevents the contacts from closing, then there could be a hard failure. Therefore, the spring force of the moving contact should be set to prevent the contacts from opening under any circumstances. The required spring force can be calculated using F=MA, where F is the spring force, M is the mass of the moving contact and spring, and A is the shock-related acceleration. The required spring force is calculated with the spring fully-compressed.

The moving contact 400*a* and the fixed contact 300*b* may both have flat contact faces or may both have tapered contact faces. Alternately, one may have a flat contact face while the other has a tapered contact face. Tapered contact faces are generally better at remaining in a mated position in the presence of shock. To prevent lateral movement of the moving contact face in a high lateral-shock environment, the fixed contact face may have an inner taper and the moving contact face may have an outer taper. Further, the angle of the tapers may be selected such that when the moving contact face mates with the fixed contact face, the outer taper of the moving contact face seats on or is wedged between the inner taper of the fixed contact face.

Figure 5C:
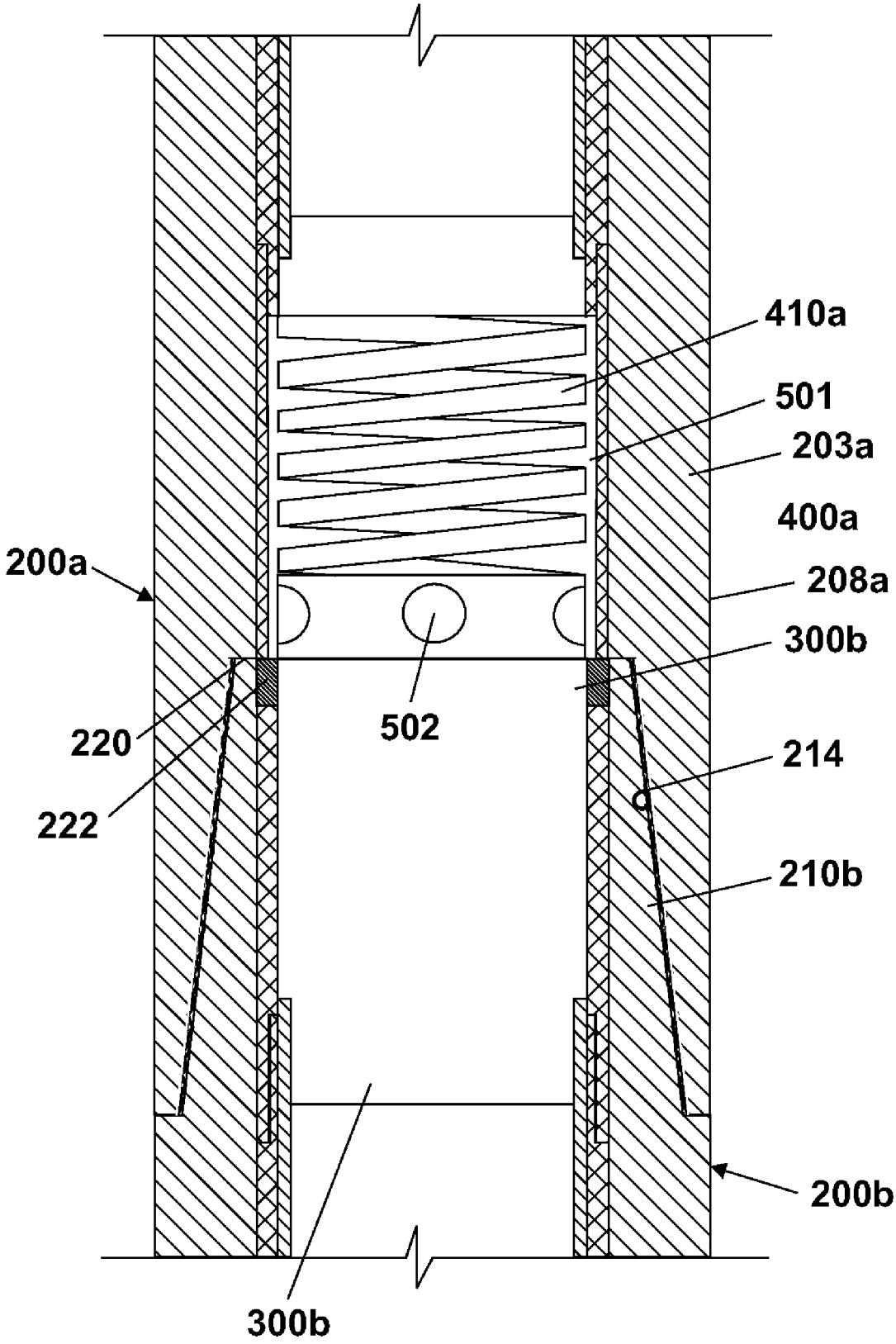
FIG. 5C shows a coaxial transmission line for an electromagnetic wellbore telemetry system modified to allow flow around a moving contact.

Debris and cement may build-up around the moving contact 400*a* and make it difficult for the moving contact 400*a* to move axially and maintain the low contact resistance at the contact faces 412*a*, 310*b*. One method for preventing sticking of the moving contact 400*a* is to apply a low-friction material at the interface between the moving contact 400*a* and the insulator 206*a*. The low-friction material may be applied on the insulator or on the moving contact. An example of a suitable low friction material is TEFLON. Another method, as illustrated in FIG. 5C, is to provide a space 501 between the insulator 206*a* and the moving contact 400*a*, openings 502 in the moving contact 400*a*, and spaces between the coils of the spring member 410*a* of the moving contact 400*a* so that drilling fluid can circulate around the moving contact 400*a*.

Returning to FIG. 2, the pipe joint 200 can be constructed using any suitable process. Initially, the outer diameter of the inner conductive pipe 212 may be smaller than the inner diameter of the outer conductive pipe 203 to facilitate insertion of the inner conductive pipe 212 in the axial bore 205 of the outer conductive pipe 203. The inner conductive pipe 212 may then be expanded to fit the inside geometry of the outer conductive pipe 203 using any suitable process, such as hydro-forming or mechanical roll-forming. In hydro-forming, high pressure fluid is used to expand the inner conductive pipe 212 and lock the inner conductive pipe 212 inside the outer conductive pipe 203. In mechanical roll-forming, a tube expander having roller bearings may be used to expand the inner conductive pipe 212 and lock the inner conductive pipe 212 inside the outer conductive pipe 203.

The inner conductive pipe 212 which is expanded to fit the inside geometry of the outer conductive pipe 203 may be provided as a solid pipe initially having a smaller outer diameter than the inner diameter of the outer conductive pipe 203. Alternatively, the inner conductive pipe 212 may be provided as a slotted or perforated pipe initially having a smaller outer diameter than the inner diameter of the outer conductive pipe 203. Alternatively, the inner conductive pipe 212 may be provided as a collapsed U-tube which when opened inside the outer conductive pipe 203 fits the inside geometry of the outer conductive pipe 203. Alternatively, the inner conductive pipe 212 may be made of a flexible pipe, for example, a plastic tube, with thin metal strips running along the length of the pipe. The plastic pipe may be collapsed into a U-shape which can be open once inside the outer conductive pipe 203 to conform to the inner geometry of the outer conductive pipe 203 and then bonded thereto, where the thin metal strips provide the conductive paths. Alternatively, an axial cut can be made along the length of a solid pipe, thereby allowing the pipe to be collapsed into a spiral. The spiral pipe can be released once inside the outer conductive pipe 203, where upon release it fits snugly against the outer conductive pipe 203. Support rings may be added to the interior of the opened pipe to provide additional strength and tack-weld the pipe in place.

Figure 6A:
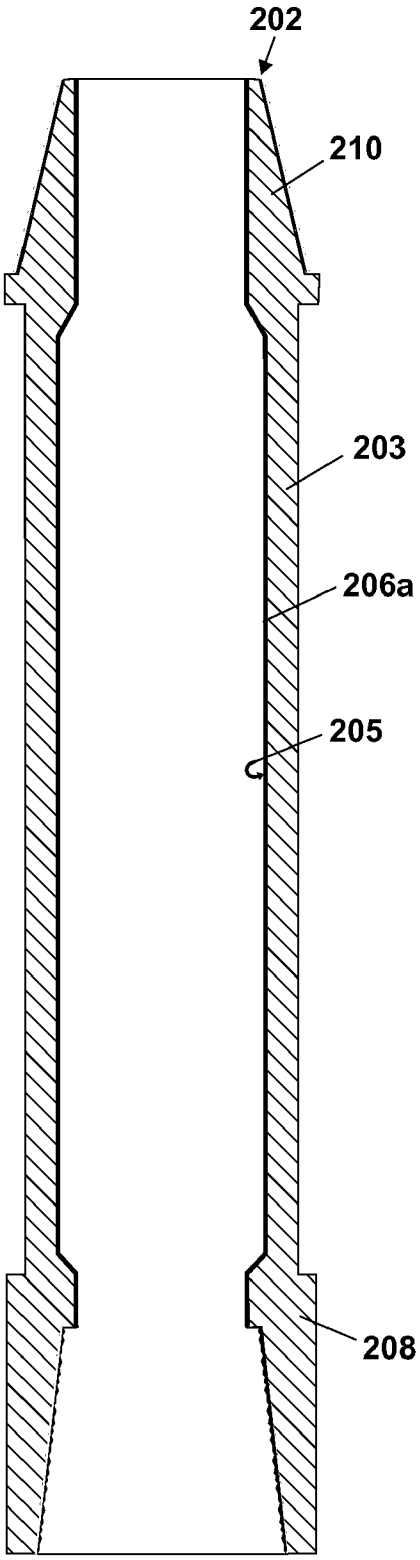
FIGS. 6A-6E illustrate a process of forming a coaxial transmission line for an electromagnetic wellbore telemetry system.
Figure 6B:
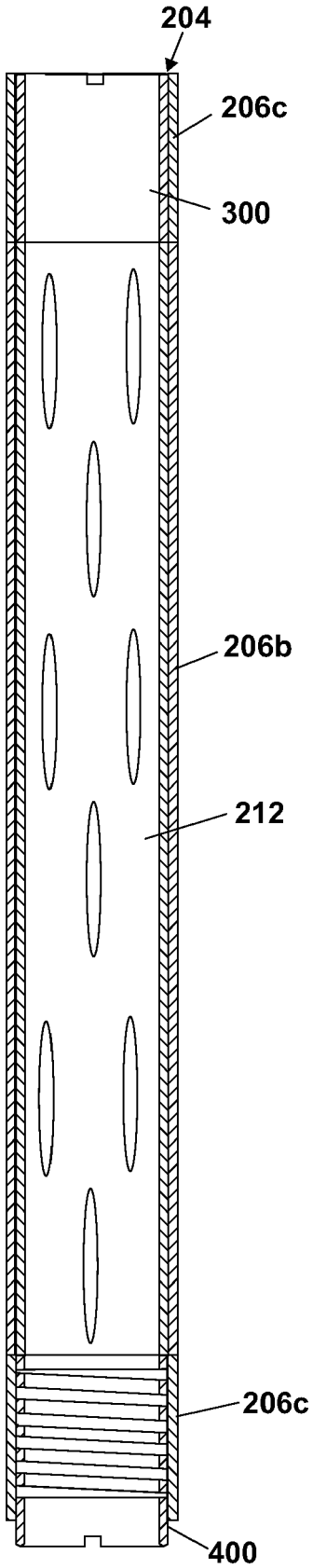
Figure 6C:
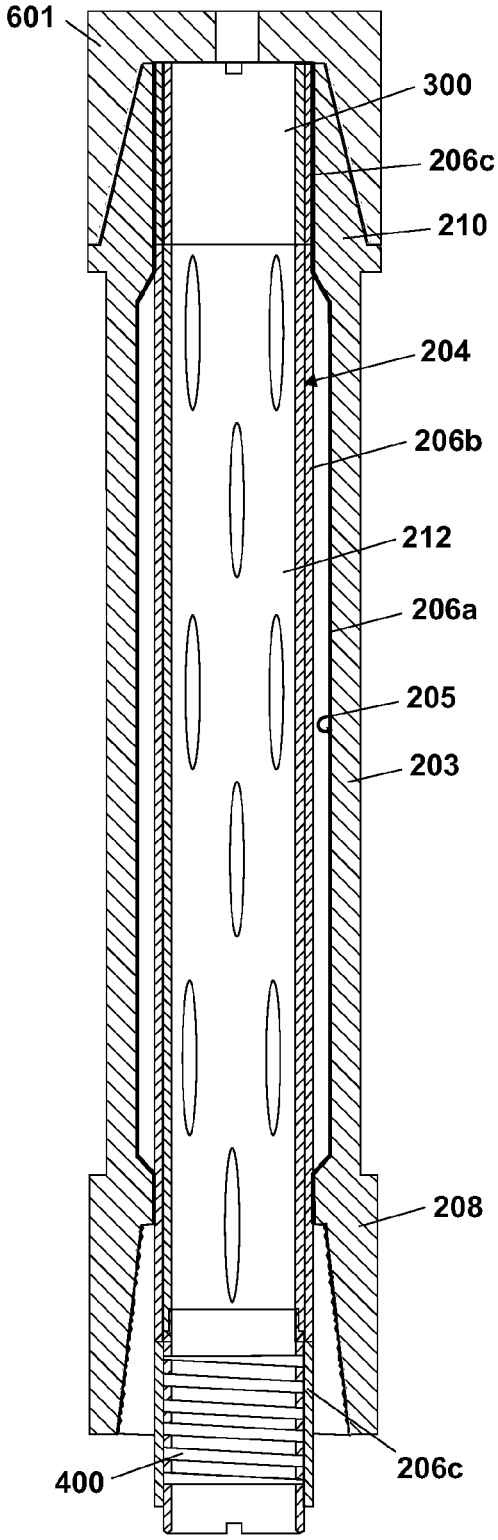

FIGS. 6A-6E illustrate a process of forming the pipe joint 200. FIG. 6A shows an outer tubular conductor 202 including an outer conductive pipe 203 having an axial bore 205 and pin and box connectors 210, 208. A thin insulating layer 206*a* may be formed on the interior wall of the outer conductive pipe 203 to provide electrical insulation and protect against corrosion. FIG. 6B shows an inner tubular conductor 204 including an inner conductive pipe 212 with fixed and moving contacts 300, 400 welded to its ends. The inner conductive pipe 212 is a slotted or perforated pipe. An insulating sleeve 206*b* is slid over the inner conductive pipe 212. In one example, the insulating sleeve 216*b* is made of fiberglass cloth, but other insulating materials such as rubber may be used. Rigid insulating sleeves 206*c* are placed over the fixed and moving contacts 300, 400. FIG. 6C shows the inner tubular conductor 204 with the insulating sleeves 206*b*, 206*c* disposed in the axial bore 205 of the outer conductive pipe 203. A manufacturing fixture 601 is used to align the fixed contact 300 to be flush with the end of the pin connector 210. The manufacturing fixture 601 also prevents the inner conductive pipe 212 from rotating inside the axial bore 205 of the outer conductive pipe 203.

Figure 6D:
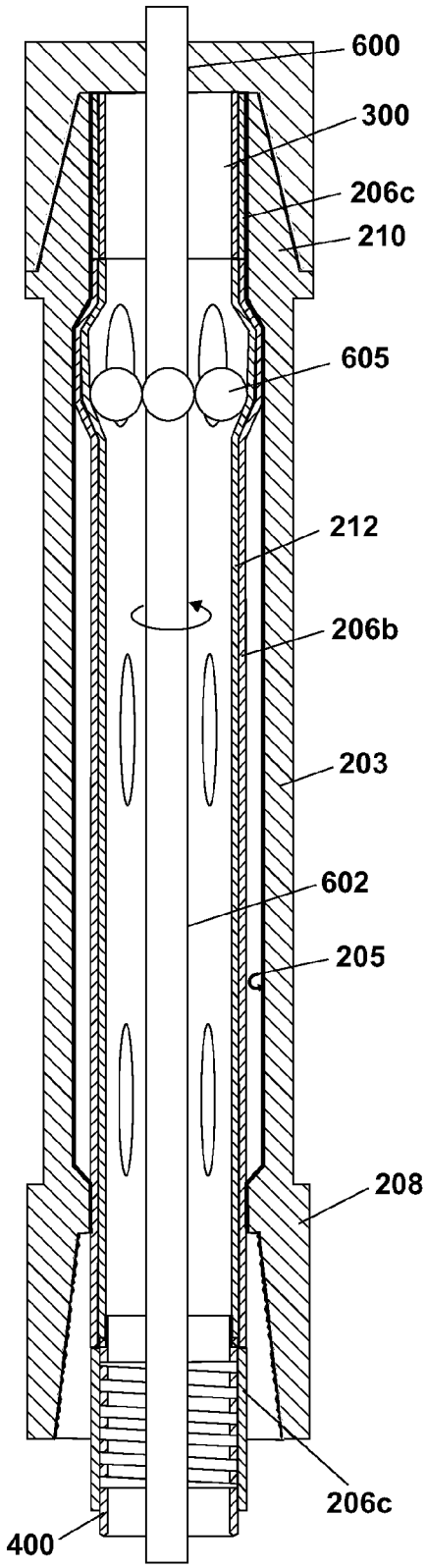

FIG. 6D shows a tube expander 600 inserted into the inner conductive pipe 212. The tube expander 600 includes a mandrel 602 carrying rollers 605 for expanding the inner conductive pipe 212. The rollers 605 are initially recessed into the mandrel 602 to allow insertion of the tube expander 600 into the inner conductive pipe 212. Inside the inner conductive pipe 212, the rollers 605 are expanded under control using drive mechanisms, such as hydraulic pistons or mechanical wedges, coupled to the rollers. To begin the process of expanding the inner conductive pipe 212, the rollers 605 are first opened at the end of the inner conductive pipe 212 connected to the pin connector 210. The mandrel 602 is then rotated and advanced along the inner conductive pipe 212, where the radial and longitudinal forces applied by the rollers 605 on the inner conductive pipe 212 expand and lock the inner conductive pipe 212 against the outer conductive pipe 203, with the insulating sleeve 206*b* sandwiched between the inner conductive pipe 212 and the outer conductive pipe 203.

Figure 6E:
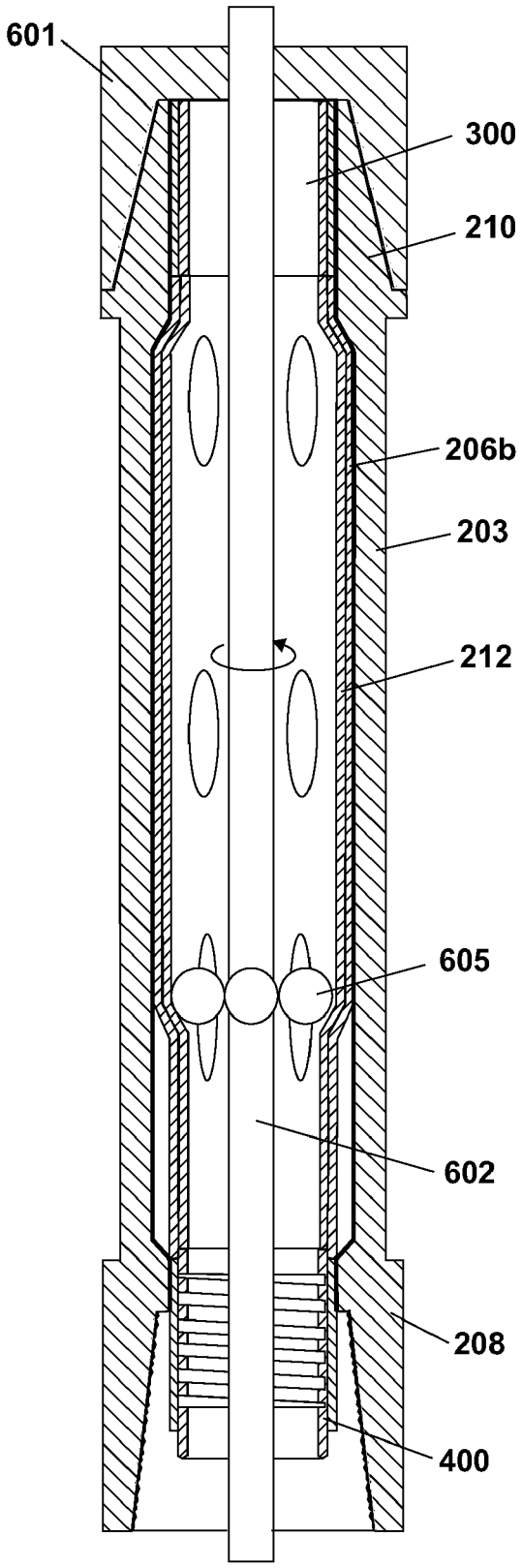

FIG. 6E shows the rollers 605 working their way toward the box connector 208. The length of the inner conductive pipe 212 contracts, bringing the moving contact 400 into position in the box connector 208. A manufacturing fixture may be used to insure the exact position of the moving contact 400 and to maintain alignment of the inner conductive pipe 212 within the axial bore 205 of the outer conductive pipe 203 as its diameter is being expanded.

After the inner conductive pipe 212 has been expanded to fit the inner geometry of the outer conductive pipe 203, the outer conductive pipe 203 may be loaded with liquid epoxy and spun so that epoxy saturates the fiberglass cloth in the insulating sleeve 206*b*. Alternatively, the insulating sleeve 206*b* may be made of fiberglass cloth pre-impregnated with epoxy. The epoxy is then cured. This provides additional mechanical strength to the pipe joint 200. This also provides an additional insulating layer and improves the corrosion resistance of the pipe joint 200. The fiberglass-epoxy layer prevents the inner conductive pipe 212 from shorting to the outer conductive pipe 203. Without the fiberglass-epoxy layer, bending and rotating the outer conductive pipe 203 might cause the inner conductive pipe 212 to rub through the thin insulating layer on the outer conductive pipe 203 and short to the outer conductive pipe 203. The fiberglass-epoxy finish also provides a smooth interior surface for the pipe joint 200, which reduces the chances that dried mud or cement builds up inside the pipe joint 200.

There is an advantage to using slotted or perforated inner conductive pipe with a fiberglass-epoxy layer compared to a solid inner conductive pipe with a rubber layer. Before a drill string has a twist-off failure, it usually develops a crack in a pipe section. This crack provides a fluid leakage path that can be detected at surface by a drop in pressure. When this pressure drop is observed, the driller pulls the drill string from the borehole and locates the damaged pipe section, thus preventing catastrophic twist-off, where the drill string must be recovered by an expensive fishing job. A solid inner conductive pipe with a rubber layer might form a temporary hydraulic barrier over a crack. If this reduces the amount of the pressure drop so that it is not detected at surface, then it is possible that the pipe joint might proceed to complete failure. Because the slotted or perforated inner conductive pipe and the fiberglass-epoxy layer will not form a pressure barrier, any crack would result in the same pressure drop as a bare drill pipe.

The electromagnetic wellbore telemetry system described above features self-cleaning electrical contacts, which are simple, yet rugged, and provide low contact resistance. The system described above does not use small wires that can break, nor does it require solder joints between wires and communication couplers, as in the case of the wired wellbore telemetry system, that can fail. The system does not rely on induction or other magnetic couplers that could be damaged while making up the pipe joints. The system is not subject to microphonic noise caused by shock and vibration. There is no need to cut grooves in the drill pipe to receive magnetic couplers or to drill holes to run wires. The system may provide high-speed, broadband telemetry between a downhole tool and a surface unit. The system has simple transmission line properties, has no cut-off frequency, and does not use temperature or pressure dependent components. The system is simple to manufacture, and trouble-shooting using, e.g., an ohm-meter, is easy. The system is effective in oil-based drilling mud, in water-based drilling mud, in foam mud, and when air is used in place of mud.

The electromagnetic wellbore telemetry system can provide communication with any element in a drill string such as heavy-weight drill pipe, jars, under-reamers, MWD and LWD tools, directional drilling tools, and drill bits. The wellbore telemetry system can be in the form of tubular strings other than a drill string, wherever it is desired to transmit signals from one end of the tubular string to the other. For example, in casing drilling, completion tubulars are used in place of drill pipe to transmit mechanical force and convey drilling mud to the drill bit. MWD, LWD, and directional drilling equipment may be run on the bottom of the casing string and retrieved before the casing string is cemented in place. This telemetry channel can be used to transmit data during the drilling process and can afterwards be used to communicate between permanently installed downhole sensors and the surface. Such downhole sensors could include temperature, pressure, formation resistivity, fluid flow sensors, for example. These sensors can be used to monitor the production from different zones. Such downhole sensors could also be powered from the surface since the channel permits low frequency current flow. Signals transmitted from the surface to downhole can be used to control valves to vary the flow from different zones to optimize hydrocarbon production and to minimize formation water production.

The electromagnetic wellbore telemetry system can be in the form of a production tubing string that is run inside of a casing. Such production tubing strings can be used to separate flow from different zones, or isolate the produced fluids from the casing cemented in the formation. The invention can be used to transmit signals between the surface and permanently installed downhole sensors, and to provide power to the downhole sensors.

The electromagnetic wellbore telemetry system can be in the form of a riser. Risers are tubulars that connect the drilling or production platform to the seabed equipment. In drilling from a floating platform, the drill pipe is contained inside the risers. A primary function of the risers is to provide a channel for mud and cuttings to be returned to the platform for processing and disposal. Without risers, the mud and cuttings are vented to the sea. A second function of the risers is to contain the high pressure of the returning mud column. When risers are used for production, they transmit the produced fluids from the seabed to the platform. In either application, the invention can be used for communication between the seabed and the platform.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A coaxial transmission line for an electromagnetic wellbore telemetry system, comprising:

an outer conductive pipe;

a perforated or slotted inner conductive pipe disposed coaxially inside an axial bore of the outer conductive pipe;

a first electrical contact having a first contact face disposed at a first end of the inner conductive pipe;

a second electrical contact having a second contact face disposed at a second end of the inner conductive pipe; and an insulator disposed between the outer conductive pipe and the inner conductive pipe.

2. The coaxial transmission line of claim 1, wherein the first contact is a fixed contact and the second contact is a moving contact.

3. The coaxial transmission line of claim 2, wherein at least one of the first and second contact faces includes at least one slot.

4. The coaxial transmission line of claim 3, wherein at least one of the first and second contact faces includes at least one taper.

5. The coaxial transmission line of claim 2, wherein the second contact face is movably coupled to the inner conductive pipe by a spring member.

6. The coaxial transmission line of claim 2, wherein the second contact face is provided at a distal end of a tubular body coupled to the inner conductive tube, said tubular body having openings which allow flow circulation.

7. The coaxial transmission line of claim 1, wherein the outer conductive pipe is selected from the group consisting of drill pipe, casing, tubing, and riser.

8. The coaxial transmission line of claim 1, wherein the outer conductive pipe includes a pin connector and a box connector at distal ends thereof.

9. The coaxial transmission line of claim 1, further comprising an annular seal retained at a distal end of the insulator.

10. An electromagnetic wellbore telemetry system, comprising:

a plurality of coaxial transmission lines connected in the form of a tubular string for an oilfield operation, each coaxial transmission line comprising:

an outer conductive pipe;

a perforated or slotted inner conductive pipe disposed coaxially inside an axial bore of the outer conductive pipe;

a first contact disposed at a first end of the inner conductive pipe;

a second contact disposed at a second end of the inner conductive pipe; and an insulator disposed between the outer conductive pipe and the inner conductive pipe.

11. The electromagnetic wellbore telemetry system of claim 10, wherein the first contact is a fixed contact and the second contact is a moving contact.

* * * * *